US008850943B2

(12) United States Patent
Brylev

(10) Patent No.: US 8,850,943 B2
(45) Date of Patent: Oct. 7, 2014

(54) MANAGEMENT SYSTEM OF SEVERAL SNIPERS

(76) Inventor: Sergey Fedorovich Brylev, Samara (RU)

( * ) Notice: Subject to any disclaimer, the term of this patent is extended or adjusted under 35 U.S.C. 154(b) by 3 days.

(21) Appl. No.: 13/515,917

(22) PCT Filed: Apr. 5, 2011

(86) PCT No.: PCT/RU2011/000222

§ 371 (c)(1),
(2), (4) Date: Jun. 14, 2012

(87) PCT Pub. No.: WO2012/138242

PCT Pub. Date: Oct. 11, 2012

(65) Prior Publication Data

US 2013/0118341 A1 May 16, 2013

(51) Int. Cl.

| | |
|---|---|
| ***F41G 3/00*** | (2006.01) |
| ***F41G 3/16*** | (2006.01) |
| ***F41A 19/08*** | (2006.01) |
| ***F41A 19/58*** | (2006.01) |
| ***F41G 3/04*** | (2006.01) |

(52) U.S. Cl.

CPC *F41G 3/00* (2013.01); *F41G 3/165* (2013.01); *F41A 19/08* (2013.01); *F41A 19/58* (2013.01); *F41G 3/04* (2013.01)

USPC ..... 89/1.11

(58) Field of Classification Search

CPC ..... F41G 1/00; F41G 1/38; F41G 1/40; F41G 3/00; F41G 3/08; F41G 3/22; F41G 5/00; F41G 5/06

USPC ..... 89/1.11; 235/400–418

See application file for complete search history.

(56) References Cited

U.S. PATENT DOCUMENTS

| | | | | | |
|---|---|---|---|---|---|
| 4,205,589 | A * | 6/1980 | Engler et al. | ..... | 89/41.07 |
| 4,256,013 | A * | 3/1981 | Quitadama | ..... | 89/41.05 |
| 4,932,831 | A * | 6/1990 | White et al. | ..... | 414/732 |
| 5,686,690 | A * | 11/1997 | Lougheed et al. | ..... | 89/41.17 |
| 5,834,676 | A * | 11/1998 | Elliott | ..... | 89/41.05 |
| 6,032,126 | A * | 2/2000 | Kaehler | ..... | 705/16 |
| 7,121,464 | B2 * | 10/2006 | White | ..... | 235/400 |
| 7,654,029 | B2 * | 2/2010 | Peters et al. | ..... | 42/111 |
| 2002/0184810 | A1 * | 12/2002 | Day | ..... | 42/79 |
| 2008/0092727 | A1 * | 4/2008 | Glascock | ..... | 89/27.3 |
| 2009/0100995 | A1 * | 4/2009 | Fisher | ..... | 89/1.11 |
| 2011/0173869 | A1 * | 7/2011 | Uhm | ..... | 42/111 |

* cited by examiner

*Primary Examiner* — Daniel J Troy
*Assistant Examiner* — Benjamin Gomberg
(74) *Attorney, Agent, or Firm* — Aleksandr Smushkovich

(57) ABSTRACT

There is proposed a system for managing fire of snipers, including a central station (CS) and a plurality of N individual kits (IK), each operated by one sniper. Preferably, the IK includes: --a rifle, --an optical sight (OS) mounted on the rifle with a mechanism for correction of the OS, --equipment including devices activating the rifle's firing pin; --a laser target designator having an axis coinciding with the OS axis, satellite navigation receiver (SNR), video-camera, symbol generator, adding device summarizing output signals, readiness sensor installed on the rifle's trigger, command decoder; zoom-lens actuator; electronic switches controlling the zoom-lens actuator, laser rangefinder; commutator receiving output signals from the laser rangefinder and SNR, and radio-modem module (IK-RM) provided with a two-way communication with the CS furnished with certain devices specified therein. The system enhances the synchronousness and target hit accuracy, and is capable of counteraction to acoustic counter-sniper systems.

8 Claims, 4 Drawing Sheets

MANAGEMENT SYSTEM OF SEVERAL SNIPERS

CROSS-REFERENCE TO RELATED APPLICATIONS

This application is a U.S. national stage application of a PCT application PCT/RU2011/000222 filed on 5 Apr. 2011, whose disclosure is incorporated herein in its entirety by reference.

FIELD OF THE INVENTION

The present invention relates to guidance and control systems for anti-terrorist operations, or for military sniper operations.

BACKGROUND OF THE INVENTION

The tactics of using sniper weapons for anti-terrorist and military operations require a synchronous volley fire made from several sniper rifles. There are cases where a terrorist group threatens a hostage's life (or lives of a group of hostages) or a suicide bomber with explosives on his body is ready for self-destruction, in which cases a military sniper operation is required. In such cases, neutralization of the terrorist's action is necessary conditioned by a simultaneously destruction of all members of the terrorist group, or a simultaneously destruction of certain parts of the suicide bomber's body, which may activate the self-destruction action, or by an accurate destruction of an enemy position by a precise ammunition. Also, sometimes, there is a need for counteraction to an acoustic counter-sniper system. Particularly, a sniper's location can be masked by providing a synchronous volley shot.

Desirable results may be obtained in case of maximal neutralization of subjective factors that affect the volley fire, and in case of maximal accounting for objective factors that affect the accuracy of hitting the target. The first group of factors includes individual psychophysical characteristics of each sniper, such as physical readiness to shoot (concentration) and the time interval between receiving a verbal command to shoot and a motor reaction of the sniper. The second group of factors includes factors affecting the flight bullet trajectory such as a distance to the target, air temperature (density), wind intensity and direction over the flight trajectory. Adjusting the flight trajectory of a high-precision ammunition is possible during the flight time by using data transmission via a radio channel.

There is known a device for automated sighting and shooting made from a rifle, and consisting of equipment installed on the rifle and on the shooter's outfit. The equipment on the rifle includes a video camera, an arm roll sensor, a laser rangefinder with a transmitter and two photo-sensors, an analog-to-digital converter, a radio-transmitter, a radio-receiver, antennas, an electromagnet with armature, an electronic switch, and a power supply unit.

The shooter's outfit includes antennas, a radio-receiver, a radio-transmitter, temperature and air pressure sensors, a video signal processing unit, a decision-making unit and other logic devices, a cross-wind speed estimator, an aiming mark driver, and a video-monitor mounted on the shooter's helmet.

According to the first modification of the aforementioned device, information from the equipment mounted on the rifle is transmitted into the shooter's outfit by using a method of electric induction from an output resonant circuit made by printed wiring on the rifle's gun-butt into a similar input resonant circuit placed on the inner palm side of the shooter's glove. Further, the signals are transmitted to the equipment outfit on the shooter's body via a cable.

According to the second modification of the aforementioned device, the equipment installed on the rifle is connected to the equipment on the shooter's body by using a common cable; there is no-cross wind speed sensor, while a correction of target accuracy is mathematically derived from the tracer bullet flight analysis shot by the shooter. According to the second modification, the shooting initiation is provided electrically: triggering the cartridge primer is executed by a high-voltage discharge. For this purpose, several dielectric bushes are installed in the steel body of breechblock to provide electric isolation of the cartridge shell from the breechblock body, and a special ammunition is used, in which the capsule is separated from the cartridge shell by using a dielectric bush [Reference Source 1].

The proposed principle of operation of the aforementioned device envisages calculating the sight correction by using the arm roll sensor, the pressure and temperature sensors, while a result of analysis of a maximal reflections difference of the laser beam in photo-sensors estimates the speed of target motion on the basis of image change in a video frame and displays an aiming mark and an impact point on a display. The shooter operates the weapon as a spatial manipulator, interposes the flashing dots on the display and the small-arm system opens fire automatically.

The aforementioned system has significant defects, namely:

1) It claims the possibility of evaluation of the cross-wind speed by calculating a time interval between the maximal amplitudes of the reflected laser beam in two photo-sensors. The physical principle and the mathematical apparatus for processing the readings photo-sensors claimed by the authors of aforementioned device do not correspond to the known methods for measurement of the transverse velocity of gas flows carrying suspended particles [Reference Source 2, [Reference Source 3]. The equipment designed according to the known methods requires fine adjustment and weights dozens kilograms. There is known the use of laser anemometry equipment only in a few models of tank ballistic calculators.

2) The authors' claimed cable and the induction methods for transmission of information from the equipment installed on the rifle to the equipment installed on the shooter's body restrict the mobility of the device.

3) The weapon breechblock is supposed to be produced in the form of several coaxial cylinders made of steel and dielectric that are materials with different thermal expansion coefficients.

4) The fundamental defect of aforementioned device is the use of the special ammunition i.e. the cartridge with a case, in which the cap is separated from the case by using the dielectric bush.

5) According to the second modification, the target accuracy adjustment is performed by using the mathematical analysis of a tracer bullet's flight trajectory, which means that the tactics for deployment the system implies only the fire in bursts.

There is known another correction system of sniper or reconnoiter rifle guidance, in different modifications, consisting of an optical telescopic sight, a view finder, a laser range finder (target designator), a ballistic calculator, weather station (s) with sensors, a laser detector "friend-or-foe", and a manual keyboard for data input [Reference Source 4].

According to one modification of the aforesaid system, the ballistic calculator collects data from the laser range finder and the weather station, and displays the value of necessary sight corrections on a display of the view finder. The display is installed inside the rifle optical sight or on a separate monitor. The sniper adjusts the sight manually corresponding to visible corrections, or the equipment has a mechanism for automatic adjustment of crosshairs image (template). The aforesaid manual keyboard allows the sniper to input/ignore the additional correction data. It is claimed that such a system allows for increasing the accuracy due to a maximal accounting of external factors affecting the accuracy. A disadvantage of the foregoing invention is the impossibility of coordination of activities of several snipers. Besides, a technical implementation and industrial applicability of the above-described invention are not disclosed by its authors.

The most similar to the claimed invention is considered a system for video control and group targeting consisting of several rifles with optical sights, wherein a video-camera and a video signal transmitter are additionally installed on each such rifle, and wherein the video camera forms an image viewable by the sniper in the sight and transmits the corresponding video signal to the transmitter's input. The transmitter is connected to a receiver via a radio channel. The video signal receivers and video-monitor are installed on a central command point (central station) of the operation commander [Reference Source 5].

A beneficial effect of using such model is claimed by its authors, who provided several examples thereof. In all of the examples, the operator (operation commander) observes the image on the video-monitor viewable in the sniper sights viewfinders. By analyzing the image, via the radio communication channel, the operator verbally controls each sniper's actions to change the angle of observed image and makes a decision to use the common volley fire or selective volley by several snipers, or the artillery guidance correction.

Further, via the radio communication channel, the operator verbally gives necessary instructions to open fire. This model has the following disadvantages, namely: there is no instrumental calculation of sight corrections, there is an intense verbal radio communication between the snipers and the operator. The model conceptually has no ability to account for external factors and individual psychophysical characteristics of each sniper on the volley fire synchronism and target hitting accuracy.

PURPOSES AND BRIEF SUMMARY OF THE INVENTION

The purposes of the present invention are: 1) increasing the target hit accuracy of the sniper rifle; 2) synchronous firing at several targets from the sniper rifles; 3) implementation of the military sniper operations; 4) counteraction to an acoustic system for location of snipers.

In practice, the present invention can be applied in military sniper operations and anti-terrorist force operations where it is necessary to synchronously hit several targets. Four exemplary options of deployment of the inventive system follow:

Deployment Option 1 is intended for an enforcement operation to release hostages whose lives and health are under a real threat.

Deployment Option 2 is intended for neutralization of the activity of a suicide bomber, who is ready for self-destruction, by synchronous firing at vital organs.

Deployment Option 3 is intended for calculation of the target coordinates and for correcting the flight trajectory of an ammunition of high-precision weapon to hit the target.

Deployment Option 4 is intended for counteraction to acoustic counter-sniper systems.

Therefore, according to a preferred embodiment of the present invention, there is proposed a system for managing fire of a plurality of snipers, said system comprises: a central station (CS) including means for verbal radio-communication with said snipers; and a plurality of N individual kits (IK), each said IK is operated by one of the snipers, each said IK comprises: --a sniper rifle having a rifle firing-trigger mechanism including a firing pin; --an optical sight (OS) mounted on said rifle, and having an axis of said OS, the OS includes a mechanism for input of corrections into said OS; --a means for verbal radio-communication with said CS; --a power supply source (PSS); --equipment mounted on said rifle, wherein the equipment includes: ---a means for activating said firing pin (FPA); ---a laser target designator (LTD) having an axis coinciding with the axis of said OS, said LTD is substantially coupled with said mechanism for input of corrections into the OS, said LTD is capable to be corrected by said mechanism for input of corrections into the OS; ---a receiver module of satellite navigation (SNR); ---a video-camera (VC); ---a digital symbol generator; ---an electronic video-mixer (herein also called an adding device) receiving and mixing said VC and said digital symbol generator; ---a sniper readiness sensor installed on said trigger, said sniper readiness sensor is connected to and capable of activating said digital symbol generator; ---a video signal compression device (VCS) receiving output signals from said electronic video-mixer; ---a command decoder (DC1); ---a zoom-lens actuator; ---a first electronic switch (ES1) receiving output signals from said DC1 and controlling said zoom-lens actuator, said ES1 applies an inverse voltage from the PSS to the zoom-lens actuator; ---a second electronic switch (ES2) receiving output signals from said DC1 and controlling said FPA; ---a laser rangefinder; ---an electronic DPDT switch (herein also called a commutator) (COMM) receiving output signals from said laser rangefinder and from said SNR; and ---an IK radio-modem module (IK-RM) receiving output signals from said VCS and from said COMM, said IK-RM transmits said VCS output signals and said COMM output signals to said CS.

According to a preferred embodiment of the present invention, the aforesaid CS further comprises: a first switch (S1); a second switch (S2); a third switch (S3); a guided rectangular waveform voltage pulse generator (SPG) controlled by said S1, S2, and S3; at least one central station radio-modem (CS-RM) for communication with said IK-RM of each said IK, said at least one CS-RM is connected with said GMC; a guided matrix switch (herein also called a guided commutator) (GMC) receiving the SPG output signals and communicates the SPG output signals in any combination to the CS-RM; a weather station module (WS) capable of registering a temperature, pressure, humidity, and wind intensity and direction; a satellite navigation receiver module (SNR); N devices (VSDC) for decompression of digital video-signals receiving output signals from said CS-RM; a video-multiplexor receiving output signals from said VSDC; a first video-monitor (VM1) receiving output signals from said video-multiplexor; a video-recorder receiving output signals from said video-multiplexor; a guided electronic rotary switch (herein also called a serial commutator) (GSC1) receiving output signals from said CS-RM; a ballistic calculator module (BC) receiving output signals from said WS, said SNR, and said GSC1, and controlling said GSC1; and a second video-monitor (VM2) receiving output signals from said BC.

According to a preferred embodiment of the present invention, the aforesaid system may further comprise a mobile relay station based on standard base-station equipment for broadband digital communication.

According to a preferred embodiment of the present invention, the system may be configured in such a way that the optical sight (OS) comprises a mechanism for input of corrections into the OS, wherein said mechanism includes a first step-type micro-actuator for inputting horizontal corrections into the OS and a second step-type micro-actuator for inputting vertical corrections into the OS; the system additionally comprises a second command decoder (DC2); a third electronic switch (ES3) receiving output signals said from DC2 and controlling said first step-type micro-actuator; and a fourth electronic switch (ES4) receiving output signals from said DC2 and controlling said second step-type micro-actuator.

DETAIL DESCRIPTION OF PREFERRED EMBODIMENTS OF THE INVENTION

Figure 1:
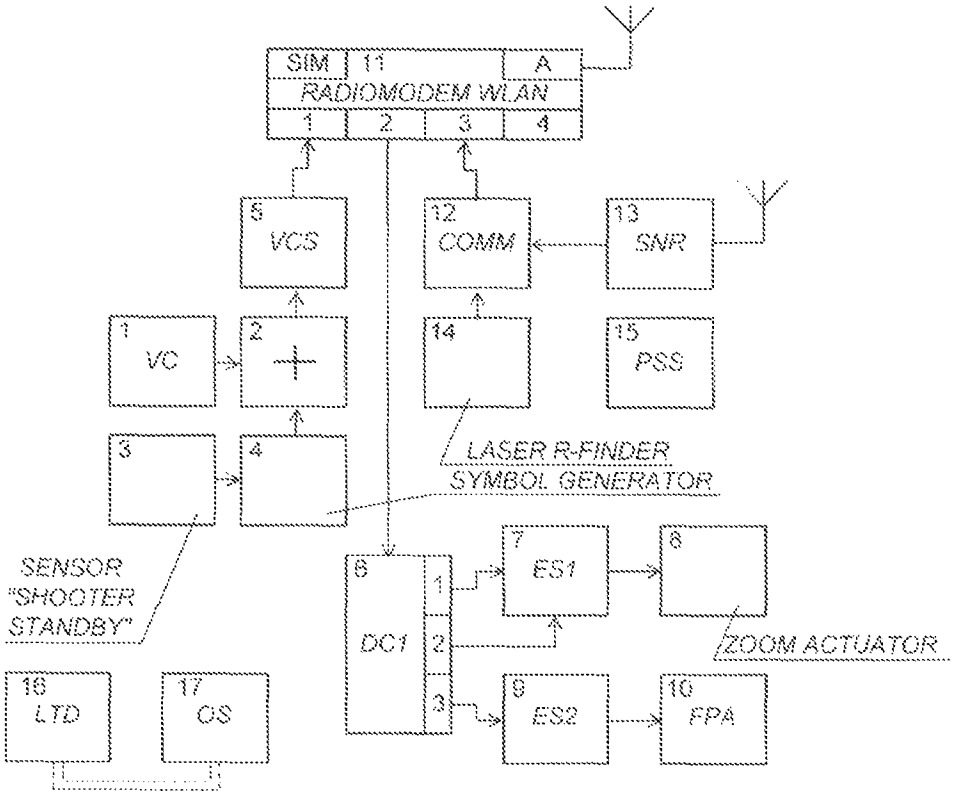
FIG. 1 illustrates a functional flowchart of an individual kit according to a first embodiment (Variant 1) of the present invention.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

To achieve the aforementioned goals, the inventive system for managing several snipers in preferred embodiments comprises: several individual kits (IK), one equipment kit of a mobile re-translator (relay), and one equipment kit of a mobile central station (CS).

Each IK includes a radio-communication component for verbal radio communication, and a sniper rifle with an optical sight (OS) 17. The OS 17 typically includes a mechanism for input of corrections thereinto, i.e. the mechanism for input of corrections into the optical sight is part of the OS 17. According to Variant 1, the equipment installed on the rifle includes (FIG. 1):

1) a laser target designator (LTD) module 16 having a casing mechanically connected to the aforesaid mechanism for input of corrections into the optical sight 17, whose optical axis is coincided with the optical axis of the optical sight 17;

2) a video-camera (VC) 1 with a digital output, an auto-diaphragm, an auto-focus, and a guided zoom-lens;

3) an adding device 2 to add video signals;

4) a sensor 3 of sniper readiness (SENSOR 'SHOOTER STANDBY');

5) a symbol generator 4;

6) a compression device 5 for compression of digital video signal (VCS);

7) a command decoder (DC) 6;

8) a first electronic switch (ES1) 7 and a zoom-lens actuator 8;

9) a second electronic switch (ES2) 9;

10) an electromechanical device (FPA) 10 including an electromagnet with a winding and a movable anchor (core), which allows making a shot from the rifle by applying voltage to the winding;

11) a radio-modem (RADIOMODEM WLAN) module 11 of broadband digital communication with four input and output ports, an antenna, and a SIM card connector socket;

12) a commutation unit, herein called a 'commutator' (COMM) 12;

13) a receiver module 13 of satellite navigation (SNR) with an antenna;

14) a laser range finder (LASER R-FINDER) 14 with a photo-detector;

15) a power supply source (PSS) 15.

The casing of LTD is fixedly coupled to the optical sight's body, both are controlled by the aforesaid mechanism for correction of input; and the axis of the optical sight matches the optical axis of the target designator. The mechanical connections between LTD 16 and OS 17 are shown by double-dashed lines in the drawings.

The rifle comprises a trigger and the aforesaid electromechanical activation device FPA 10 being part of a rifle firing-trigger mechanism of the rifle. The "sniper standby" sensor 3 is installed on the trigger. The standby sensor is connected to the aforesaid digital symbol generator 4, whose output and the output of the digital VC1 are connected to two inputs of the adding device 2. The output of the adding device 2 is connected to the input of VCS 5, whose output is connected to a first port of the RADIOMODEM WLAN 11.

The first electronic switch 7 (ES1) applies an inverse voltage from the power supply source 15 (PSS) to the zoom-lens actuator 8; the control inputs of ES1 are connected to the first and second outputs of the command decoder 6 (DC).

The electromagnet of the activation device FPA 10 is connected to the second electronic switch 9 (ES2), whose input is connected to the PSS 15, while the control input is connected to the third output of the command decoder 6 (DC1).

The input of DC 6 is connected to the second port of RADIOMODEM WLAN 11. The output of commutator 12 is connected to the third port of RADDIOMODEM WLAN 11, while the output of SNR 13 is connected to the first input of commutator 12, and the output of the laser range finder 14 is connected to the second input of commutator 12. The laser range finder 14 determines the distance to the target by registering impulses of the reflected laser beam of LTD in the photo-detector.

The commutator 12 with a preset frequency commutes (designates the routes) the data flow from the range finder 14 and SNR 13. The SIM-card stores a recorded own subscriber's number therein N numbers of RADIOMODEM WLAN 20 of the central station (CS).

The use of a bipod (double, triple) is necessary for the rigid fixing the rifle's body on the ground surface. It is necessary to remove small image movements on the screen, to remove the trembling effect of the laser beam point, to minimize the reactive impulse when shooting.

The aforementioned mobile relay kit is a standard switching equipment of a broadband digital communication base station mounted on a mobile platform (not shown).

According to Variant 1, the mobile CS equipment (shown on FIG. 2) comprises:

-a first switch (S1), -a second switch (S2), -a third switch (S3), -a guided square voltage pulse generator (SPG) 18, -a guided matrix commutator "1×N" (GMC) 19 (here and further: "1×N"—"one input—N outputs", "N×1"—"N inputs—1 output"), -N-modules of a radio-modem (RADIOMODEM WLAN) 20 for broadband digital communication with four input and output ports, antennas, and connector sockets of a SIM card, -N-devices for decompression of digital video-signals (VSDC) 21, -a video-multiplexor "N×1" 22, -a first video-monitor (VM1) 23, -a video-recorder with a date/time generator 24, -a guided serial commutator (GSC1) "N×1" 25, -a ballistic calculator module (BC) 26, -a weather station module (WS) 27 with a temperature detector, a pressure sensor, a humidity detector, and a wind intensity and direction detectors, -a satellite navigation receiver module (SNR) 28 with an antenna, -a second video-monitor (VM2) 29, and -a power supply source (PSS) 30.

Figure 2:
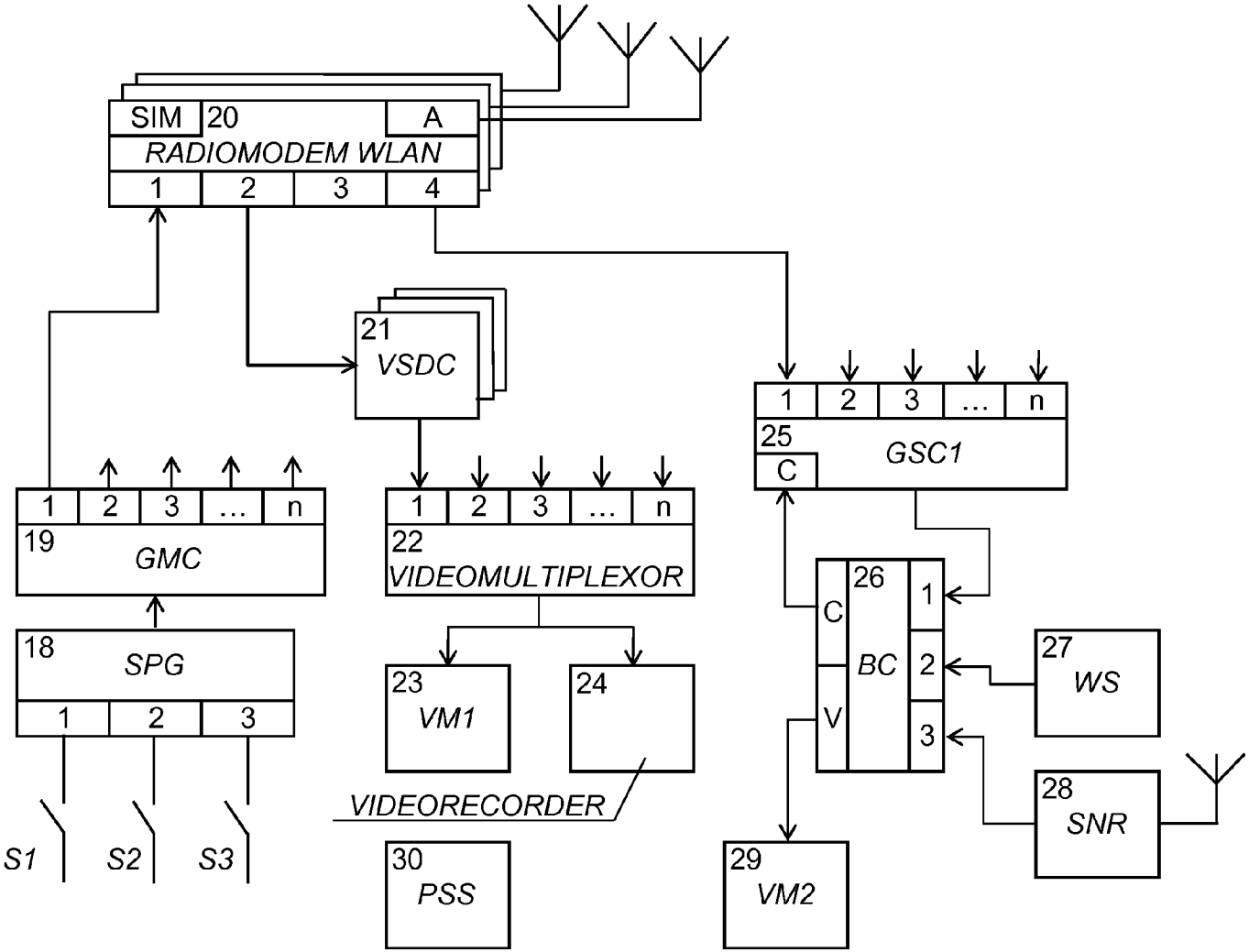
FIG. 2 illustrates a functional flowchart of a central station according to the first embodiment (Variant 1) of the present invention.

As depicted on FIGS. 2, S1, S2, and S3 are connected correspondingly to the first, the second and the third inputs of SPG 18, whose output is connected to the input of GMC 19. Each N output of GMC 19 is connected to the respective first port of RADIOMODEM WLAN 20 corresponding to the serial numbers. The inputs of VSDC 21 are connected to the second ports of RADIOMODEM WLAN 20, and the respective outputs of VSDC 21 are connected to the inputs of video-multiplexor 22 corresponding to the serial numbers; the input of VM1 23 and the input of video-recorder 24 are both connected to the output of video-multiplexor 22.

The inputs of GSC1 25 are connected to the respective fourth ports of RADIOMODEM WLAN 20, corresponding to the serial numbers; the output of GSC1 25 is connected to the first input of BC 26. The output of WS 27 with the above-listed sensors, and the output of SNR 28 are connected to the second and third inputs of BC 24. The input of VM2 27 is connected to the video output of BC 26. The control output of BC 26 is connected to the control input of GSC1 25. The SIM-card is inserted into a respective connector socket of each RADIOMODEM WLAN 20.

According to Variant 2 (shown on FIG. 3), each IK in addition has a second command decoder (DC2) 31, a third electronic switch (ES3) 32 and a fourth electronic switch (ES4) 33, a first step-type micro-actuator 34 is part of the aforesaid mechanism for input of (horizontal) corrections into the OS 17, and a second step-type micro-actuator 34 is part of the aforesaid mechanism for input of (vertical) corrections into the OS 17. The mechanical connections between LTD 16, OS 17, the micro-actuator 34, and micro-actuator 35 are shown by double-dashed lines in the drawings.

In this regard, the fourth port of RADIOMODEM WLAN 11 is connected to the input of DC2 31, whose first and second outputs are connected to the control inputs of ES3 32, while the third and the fourth outputs of DC2 31 are connected to the control inputs of ES4 33. The electronic switches apply an inverse voltage from PSS 15 (FIG. 3) to the first and the second micro-actuators 34 and 35 (FIG. 3).

Figure 3:
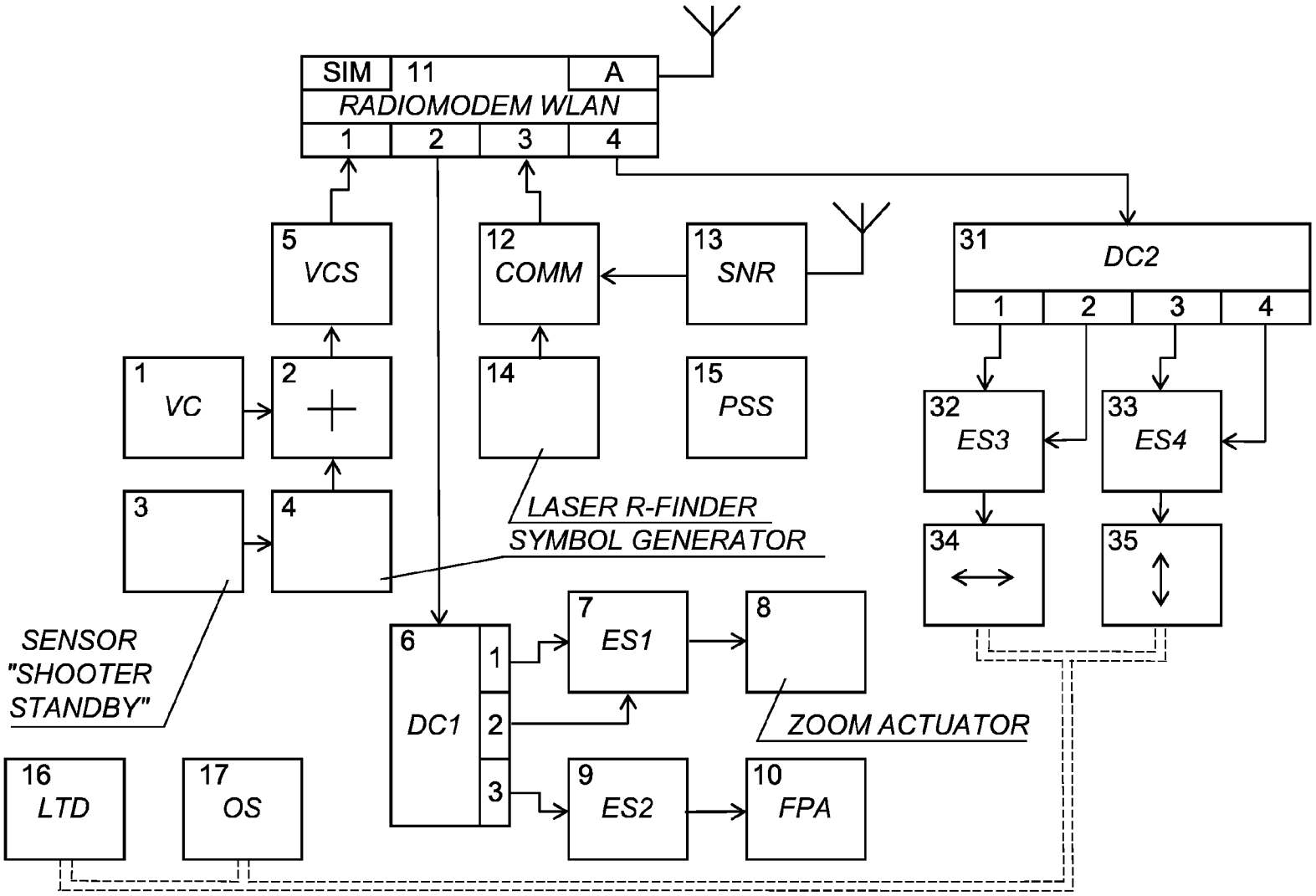
FIG. 3 illustrates a functional flowchart of an individual kit according to a second embodiment (Variant 2) of the present invention.
Figure 4:
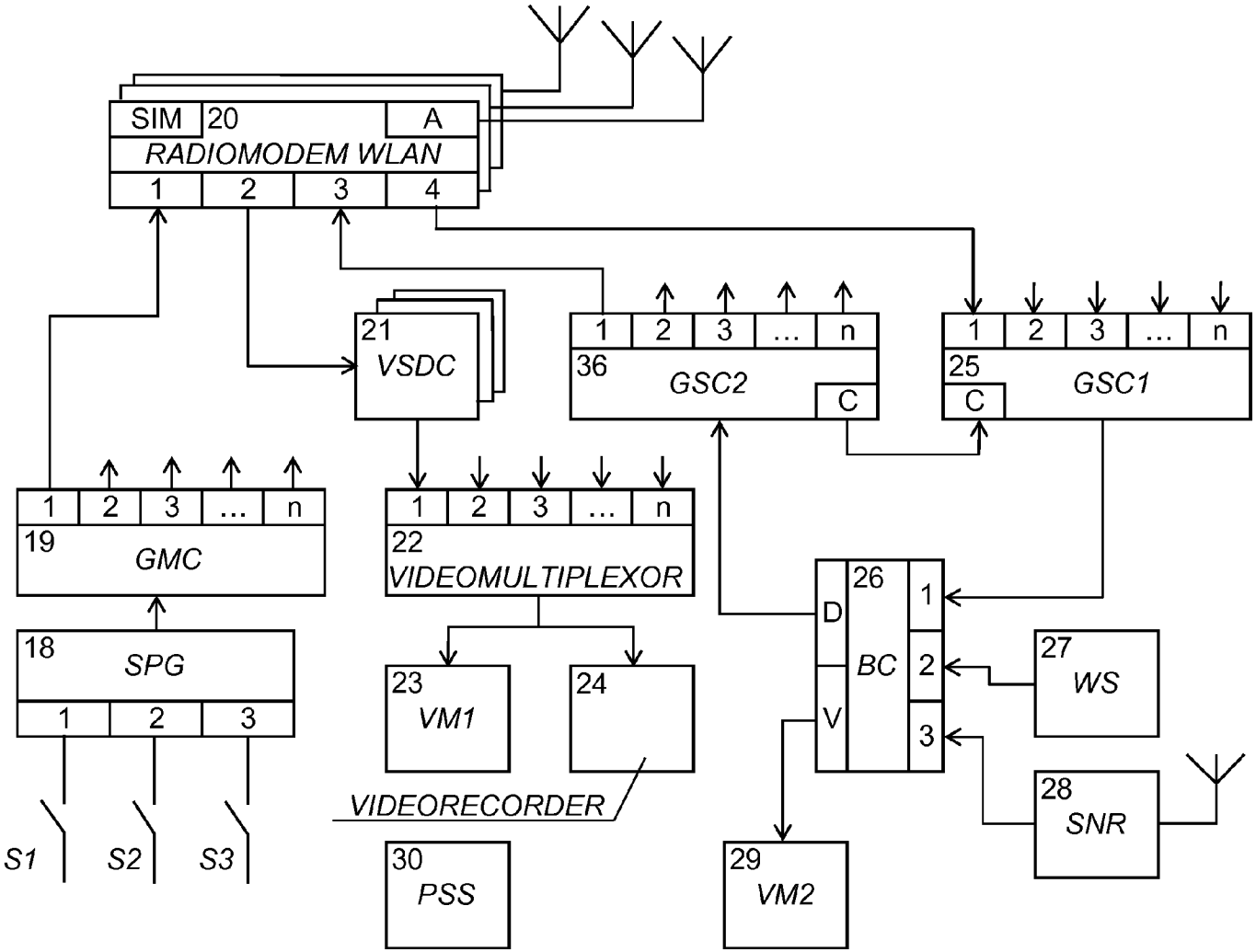
FIG. 4 illustrates a functional flowchart of a central station according to the second embodiment (Variant 2) of the present invention.

According to Variant 2 (shown on FIG. 4), the CS equipment has additionally a second serial commutator (GSC2) "N×1" 36 with a control output, and BC 26 has an extra data transmission output to control the micro-actuators 34 and 35 (FIG. 3).

The data transmission output of BC 24 is connected to the respective input of GSC2 36, and each of N outputs of GSC2 36 is connected to the respective fourth ports of RM 20, corresponding to the serial numbers. The control output of GSC2 36 is connected to the control input of GSC1 25.

The above-described components of the claimed invention are structurally designed according to known rules and made based on known elements in compliance with the requirements of signal intensity, supply voltage, and a necessary speed of action [Reference Source 6].

Small-sized video cameras with an auto-diaphragm, an auto-focus and a guided zoom-lens are known and widely used. A remote change of the lens' observation angle is carried out by applying the inverse voltage to the step-type zoom-lens actuator (34 or 35) via ES1 7. Instructions to turn the switch (logical "1") are transmitted from the first and the second outputs of DC1 6.

In the same way, ES2 9 supplies a predetermined voltage to the electromagnet of the actuator FPA 10 capable of activating the firing pin at a respective command from the third output of the decoder DC1 6. In some embodiments, the actuator's (FPA 10) electromagnet has a movable armature, which operates as a firing pin.

In alternative embodiments, the actuator includes a transfer device (rod, pusher, etc.), which disconnects the fully armed trigger and the sear-notch lug, holding the trigger in this armed position.

An implementation of the "sniper standby" sensor is possible based on a capacitive sensor of the type of B6TS-04LT "OMRON" or based on the touch-sensor QT113-D. The sensor contact on an insulating substrate is installed on the trigger surface under the sniper's forefinger.

The signal from the "sniper standby" sensor is amplified up to the logical "1" level. This signal is an instruction to the generator to generate (or to extract from memory) a video signal of display mark. The video signal of display mark is mixed with the video signal from VC 1 in the adding device 2 and is transmitted to VSC 5 where it is compressed according to a known method [Reference Source 7] and is further transmitted to the first port of RADIOMODEM WLAN 11.

SNR 13 is an ultra-small chip-set with an outer antenna installed on the rifle body. There is known a design of SNR 13 in the form of SMD-modules, for example, EMD3622F by a company named "eRide-22".

The broadband digital communication radio-modem 11 can preferably be implemented employing a wide range of equipment of the WMAN technology [Reference Source 8]. The communication between the IK and the CS is carried out automatically, according to the current communication protocols of WMAN.

The aforementioned relay station (re-translator) is needed to provide commutation and to organize stable communication between several IKs and the CS in the conditions of a complex land relief, dense urban developments, and barriers in the form of walls and bridgings. A mobile field-type relay station can be implemented based on standard base-station equipment for broadband digital communication. Nowadays, wireless broadband networks of digital communications are well known and continuously being improved.

The relay station equipment can be mounted on any transportation platform such as a car, a helicopter, a water transportation vehicle, or in a haversack (kitbag).

A CS operator may control the video camera zoom-lens (change the aspect angle and the sight panorama) by commutation of the switches S1 or S2 (shown in FIG. 2). Upon closure of these switches, SPG 18 generates (extracts from memory) code packages in the form of sets of square logic "1" level pulses. Upon opening the switch, the code package stops being generated. The code packages from the output of generator SPG 16 are transmitted to the input of GMC 19.

The matrix commutator "1×N" GMC 19 is a device which makes it possible to communicate one input with N outputs in any combination. From each output of GMC 17, the control signals are transmitted to the first ports of RADIOMODEM WLAN 20 having the numbers corresponding to the serial numbers of respective outputs, and then are transmitted to the IK equipment.

Video information received from the second ports of each RADIOMODEM WLAN 20 is transmitted to N-devices of VSDC 21 and further to N-inputs of video-multiplexor 22 having the numbers corresponding to the RADIOMODEM WLAN serial numbers. The video-multiplexor is a device, which makes it possible to simultaneously display the N video-windows (multiplexing), or selectively display one full image on a video-monitor screen.

The integrated video-signal from the output of video-multiplexor 22 is transmitted to VM1 23 and in parallel, to the video-recorder 24.

Information about coordinates of the IK positions and the target distance is transmitted from the forth ports of each RADIOMODEM WLAN 20 to the N-inputs of GSC1 25 (FIG. 2) in accordance with the serial numbers.

The guided serial commutator "N×1" GSC1 25 (FIG. 2) is a device that sequentially switches one output to each of the N inputs with a pre-set frequency. The output of GSC1 25 is connected to the first input of ballistic calculator BC 26. The instruction to connect GSC1 25 to the next RADIOMODEM WLAN 20 is delivered from the control output of BC 26 to the control input of GSC1 25 upon recording information from the current IK into the database.

Information from WS 27 (FIG. 2) is transmitted to the second input of BC 26. WS 27 may be implemented based on the equipment kit of Davis Vantage Pro2 Plus weather station, by "Davis Instruments" or GWS10 weather station with a set of sensors by "Garmin".

Information with CS position coordinates is transmitted from the output of SNR 28 to the third input of BC 26. BC 26 processes the information constantly, cyclically, at specified intervals, connecting to each IK via RADIOMODEM WLAN 20. The processing result with sight corrections of each IK, in the alphanumeric form suitable for visual read-out, is transmitted from the video-output of BC 26 to the input of VM2 29. BC 26 includes a database with uploaded terrain maps and a keyboard (if needed) to input the data on target coordinates. BC 26 may be implemented based on modern PC platforms.

The individuality of each radio-modem in the system is determined by a set of subscriber addresses (numbers) that are registered on individual SIM-cards.

According to Variant 2, BC 26 generates signals controlling the micro-actuators 34 and 35 and has a supplementary data transmission output. A set of code pulses is transmitted from the supplementary data transmission output to the input of "1×N" GSC2 36. Further, it is transmitted from each N-output of commutator GSC2 36 to the third ports of RADIOMODEM WLAN 20 having the numbers corresponding to the serial output numbers.

After the code signal from the n-th output of GSC2 36 (wherein 'n' is a number of numerical sequence from 1 to N) has reached the fourth port of the n-th RADIOMODEM WLAN 20, GSC2 36 generates and transmits a switching signal to the control input of GSC1 25. The commutators are simultaneously switched from the n-th modem to the n+1 modem. RADIOMODEM WLAN 11 of an individual kit receives the control signals and transmits them from the fourth port thereof to the input of DC2 31. After decoding the code package, DC2 31 initiates the corresponding activation of ES3 32 and ES4 33 that apply the inverse voltage to the first and the second micro-actuators 34 and 35.

POSSIBLE OPERATION OF THE INVENTION

By using the claimed system the posed problems are solved as follows. Each sniper, being in the firing line, activates the IK power supply. At the same time, the relay station and CS operators activate the common equipment by switching on the power supply. There occurs an activation of the electronic component parts, an automatic identification of the coordinate position, the distance to the target, and establishing of an IK communication line with CS. Further, the equipment of each IK transmits the coordinate information, the target distance information, and the images to CS. BC 26 processes the information from each IK, calculates the coordinates of group target, automatically reads out the information from WS 27 and SNR 28, calculates the corrections for each IK and transmits the information about corrections to VM2 29 in a form being easy to read.

The incoming video information from each IK is displayed on the screen of VM1 23 in a multiplexed form on N video-windows. The operator can control the video camera zoom-lens by closing the first and the second keys, by switching the matrix commutator in the required combinations, thereby achieving the required size of the target image in each local video window. The impact point (the mark of the laser target designator) is reflected on the screen on the target image in a form of a bright white spot.

Using a service radio-channel, the operator verbally assigns to each sniper the individual target in the group, the point of aim and the sight individual corrections.

Further, each sniper inputs the corrections to the optical sight, releases the rifle safety lock, reloads his rifle, and takes the sight. Then, by putting the forefinger onto the trigger, the sniper activates the sensor of the standby detector. A mark "readiness" appears on VM1 23 screen in an individual video window of the given IK. (The sniper can cancel the state of "readiness" by removing the finger from the trigger, thereby the generation of video tag stops).

After each video-window displayed the "readiness" mark the operator connects the controlled generator output to the first ports of all N-radio-modems by controlling the matrix commutator. Further, the operator transmits the shot activation signal "fire" to all of N-IK by closing S3. The equipment of each IK receives the signal, processes and executes it, thereby supplying power to the electromagnet of the actuator FPA 10. In some embodiments, the electromagnet disconnects the combat trigger and the sear-notch lug engagement via the traction rod (pusher, etc.); the trigger activates the hummer and the firing pin, and a shot occurs.

An option of direct breaking of the cartridge primer using the armature-firing pin of the electromagnet is also possible. The operator can create local groups of snipers by commuting to the matrix commutator the required combinations of IK connections. To activate a volley fire of the local group, it is necessary to activate S3.

According to Varian 2, the operator has no need to assign a target verbally, and each sniper has no need to manually input the corrections into the optical sight mechanism. The ballistic calculator BC 26 remotely controls the correction input mechanism in each of N-IK. The automatic correction is continuous during the whole operation time.

In both, Variant 1 and Variant 2 of the claimed invention, there is a possibility of correction of guidance of rocket launchers and artillery. As usual, the commander of operation verbally assigns the target location and sight correction to the artillery section. There is a possibility of continuous (on-line) correction of the flight trajectory of a highly precise ammunition through a radio-channel from the information output of BC module 26 via a radio transmitter directly to the receiving part of the radio (or IR, or laser beam) channel ammunition equipment being a guided artillery shell or a guided missile.

In both Variant 1 and Variant 2 of the claimed invention, there is a possibility of the counteraction to an acoustic counter-sniper system. Known acoustic counter-sniper systems use calculation of the difference between the time of the detecting the shockwave of supersonic bullet and the time of detecting the sound of a muzzle blast. Several acoustic sensors, placed in the protected area, detect sounds [Reference Source 9]. Having several synchronous supersonic shockwaves and mazzle blasts however complicates their time comparison, as well as the following mathematical analysis thereof.

INDUSTRIAL APPLICABILITY

Currently, all units and components of the claimed solution are well developed or may be developed by the industry; therefore one should consider the proposed invention meeting that requirement. The advantages of the proposed system are that the system provides a synchronous hitting the group targets, an increased hit precision due to the instrumental calculation of the sight correction and exclusion of the human factor while shooting; there is a possibility of counteraction to acoustic counter-sniper systems. The proposed system uses standard ammunition. It is characterized with a minimum weight of components being installed on rifle; it eliminates the necessity of cable connection between the sniper and the weapon, as well as it possesses a high degree of industrial applicability.

REFERENCE SOURCES

1. RU 2240485 C2 F41G 3/00, Apr. 9, 2002. "Device for automatic sighting and shooting from small arms (modifications)".
2. Universal Decimal Classification 532.574.082: 54. B. S. Rivkus, V. I. Smirnov, E. A. Sokolova. "Autometry" No. 3: "Methods and apparatus for laser Doppler anemometry (LDA)".—M.: Academy of Science, USSR, 1982.
3. Universal Decimal Classification 621.39.1.: 621.378: 532.57. V. S. Sobolev. "Autometry" No. 3: "Potentialities of laser Doppler anemometry".—Novosibirsk.: Academy of Science, USSR, 1982.
4. WO/2008/157309 "Scout Sniper Observation Scope"
5. RU 26113 U1 F41G1/38, Mar. 6, 2002. "A system of long-range discreet video surveillance and group destruction of a target"
6. U. N. Eropheev, "Pulsing device"—M.: "High school", 1989.
7. I. Oleinik, <<Hardware compression>>.—<<Safety systems>>, 2005, No. 1.
8. I. Shahnovich "Broadband Mobility": IEEE 802.16th. Part 2: Physical layer and the elementary base."—"Electronics: Science and Research Library", 2008, No. 1.
9. U.S. Pat. No. 8,005,631 B2 Aug. 23, 2011 "System and method for identifying a muzzle blast using a multi-sensor using a multi-sensor total energy approach."

The invention claimed is:

1. A system for managing fire of a plurality of sniper rifles adapted to be operated by users, said system comprising: a central station (CS) including means for verbal radio-communication with said users, said CS operatively producing CS output signals; and a plurality of N individual kits (IK), wherein N is a positive integer number, each said IK comprises:

a sniper rifle having a rifle firing-trigger mechanism including a firing pin;

an optical sight (OS) mounted on said rifle, and having an axis of said OS, the OS includes a mechanism for input of corrections into said OS;

a power supply source (PSS) operatively producing a feed voltage;

equipment mounted on said rifle, including:

a means for activating said firing pin (FPA);

a laser target designator (LTD) having an axis coinciding with the axis of said OS, said LTD has a casing mechanically coupled with said mechanism for input of corrections into the OS, said LTD is capable to be corrected by said mechanism for input of corrections into the OS;

a receiver module of satellite navigation (SNR) operatively producing SNR output signals;

a video-camera (VC) operatively producing VC output signals;

a digital symbol generator (DS) operatively producing DS output signals;

an electronic video-mixer receiving and mixing said VC and DS output signals;

a sniper readiness sensor installed on said trigger, said sniper readiness sensor is connected to and capable of activating said digital symbol generator;

a video signal compression device (VCS) receiving output signals from said video mixer and operatively producing VCS output signals;

a command decoder (DC1) operatively producing DC1 output signals;

a zoom-lens actuator;

a first electronic switch (ES1) receiving said DC1 output signals and controlling said zoom-lens actuator by applying an inverse voltage, being inverse to said feed voltage, to the zoom-lens actuator;

a second electronic switch (ES2) receiving said DC1 output signals and controlling said FPA;

a laser rangefinder (LR) operatively producing LR output signals;

an electronic DPDT switch (COMM) switching said LR output signals and said SNR output signals, thereby operatively producing COMM output signals; and an IK radio-modem module (IK-RM) receiving said VCS output signals, said COMM output signals, and said CS output signals; said IK-RM transmits said CS output signals to said DC1 operatively decoding said CS output signals; said IK-RM transmits said VCS output signals and said COMM output signals to said CS.

2. The system according to claim 1, wherein said CS further comprising:

a first switch (S1);

a second switch (S2);

a third switch (S3);

a guided rectangular waveform voltage pulse generator (SPG) controlled by said S1, S2, and S3; said SPG operatively produces SPG output signals;

at least one central station radio-modem (CS-RM) for communication with said IK-RM of each said IK; said CS-RM operatively produces CS-RM output signals;

a guided matrix switch (GMC) receiving said SPG output signals and communicates said SPG output signals in any combination to the CS-RM; said at least one CS-RM is connected with said GMC;

a weather station module (WS) capable of registering a temperature, pressure, humidity, and wind intensity and direction; said WS operatively produces WS output signals;

a satellite navigation receiver module (SNR) operatively producing SNR output signals;

N devices (VSDC) for decompression of digital video-signals; said VSDC receives said CS-RM output signals and decompresses thereof; said VSDC operatively produces VSDC output signals;

a video-multiplexor receiving said VSDC output signals; said video-multiplexor operatively produces video-multiplexor output signals;

a first video-monitor (VM1) receiving said video-multiplexor output signals for visual display of said VC output signals;

a video-recorder receiving said video-multiplexor output signals;

a guided electronic rotary switch (GSC1) receiving said CS-RM output signals, and operatively produces GSC1 output signals;

a ballistic calculator module (BC) receiving said WS output signals, said SNR output signals, and said GSC1 output signals, controlling said GSC1, and operatively produces BC output signals; and a second video-monitor (VM2) receiving said BC output signals for visual display thereof.

3. The system according to claim 1 further comprising a mobile relay station capable of broadband digital communication.

4. The system according to claim 1, wherein said VC is represented by a thermal imagery camera furnished with a digital output, an auto focus, an auto diaphragm, and a guided zoom-lens.

5. A system for managing fire of a plurality of sniper rifles adapted to be operated by users, said system comprising:

a central station (CS) including means for verbal radio-communication with said users;

and a plurality of N individual kits (IK) wherein N is a positive integer number, each said IK is operated by one of the users; said CS transmits CS signals; each said IK comprises:

a sniper rifle having a rifle firing-trigger mechanism including a firing pin;

an optical sight (OS) mounted on said rifle, and having an axis of said OS; said OS includes a mechanism for input of corrections into the OS; said mechanism for input of corrections into the OS includes a first step-type micro-actuator for inputting horizontal corrections into the OS and a second step-type micro-actuator for inputting vertical corrections into the OS;

a power supply source (PSS) operatively producing a feed voltage;

equipment mounted on said rifle, including:

a means for activating said firing pin (FPA);

a laser target designator (LTD) having an axis coinciding with the axis of said OS, said LTD has a casing mechanically coupled with said mechanism for input of corrections into the OS, said LTD is capable to be corrected by said mechanism for input of corrections into the OS;

a receiver module of satellite navigation (SNR) operatively producing SNR output signals;

a video-camera (VC) operatively producing VC output signals;

a digital symbol generator (DS) operatively producing DS output signals;

an electronic video-mixer receiving and mixing said VC and DS output signals;

a sniper readiness sensor installed on said trigger, said sniper readiness sensor is connected to and capable of activating said digital symbol generator;

a video signal compression device (VCS) receiving output signals from said video mixer and operatively producing VCS output signals;

a first command decoder (DC1) operatively producing DC1 output signals;

a zoom-lens actuator;

a first electronic switch (ES1) receiving said DC1 output signals and controlling said zoom-lens actuator, by applying an inverse voltage, being inverse to said feed voltage, to the zoom-lens actuator;

a second electronic switch (ES2) receiving said DC1 output signals and controlling said FPA;

a laser rangefinder (LR) operatively producing LR output signals;

an electronic DPDT switch (COMM) switching said LR output signals and said SNR output signals, thereby operatively producing COMM output signals;

a second command decoder (DC2) operatively producing DC2 output signals;

a third electronic switch (ES3) receiving said DC2 output signals and controlling said first step-type micro-actuator;

a fourth electronic switch (ES4) receiving said DC2 output signals and controlling said second step-type micro-actuator; and an IK radio-modem module (IK-RM) receiving said VCS output signals said COMM output signals, and said CS output signals; said IK-RM transmits said CS output signals, to said DC1 and to said DC2 operatively decoding said CS output signals; said IK-RM transmits said VCS output signals and said COMM output signals to said CS.

6. The system according to claim 5, wherein said CS further comprising:

a first switch (S1);

a second switch (S2);

a third switch (S3);

a guided rectangular waveform voltage pulse generator (SPG) controlled by said S1, S2, and S3; said SPG operatively produces SPG output signals;

at least one central station radio-modems (CS-RM) for communication with said IK-RM of each said IK; said CS-RM operatively produces CS-RM output signals;

a guided matrix switch (GMC) receiving said SPG output signals; said at least one CS-RM is connected with said GMC;

a weather station module (WS) capable of registering a temperature, pressure, humidity, and wind intensity and direction; said WS operatively produces WS output signals;

a satellite navigation receiver module (SNR) operatively producing SNR output signals;

N devices (VSDC) for decompression of digital video-signals; said VSDC receives said CS-RM output signals and decompresses thereof; said VSDC operatively produces VSDC output signals;

a video-multiplexor receiving said VSDC output signals; said video-multiplexor operatively produces video-multiplexor output signals;

a first video-monitor (VM1) receiving said video-multiplexor output signals for visual display of said VC output signals;

a video-recorder receiving said video-multiplexor output signals;

a first guided electronic rotary switch (GSC1) receiving said CS-RM output signals, and operatively produces GSC1 output signals;

a ballistic calculator module (BC) receiving said WS output signals, said SNR output signals, and said GSC1 output signals, and operatively produces BC output signals; and a second guided electronic rotary switch (GSC2) receiving said BC output signals, and controlling said GSC1 and communicating with said at least one CS-RM; and a second video-monitor (VM2) receiving said BC output signals for visual display thereof.

7. The system according to claim 5 further comprising a mobile relay station capable of broadband digital communication.

8. The system according to claim 5, wherein said VC is represented by a thermal imagery camera furnished with a digital output, an auto focus, an auto diaphragm, and a guided zoom-lens.

* * * * *